US006565133B1

(12) United States Patent
Timothy

(10) Patent No.: US 6,565,133 B1
(45) Date of Patent: May 20, 2003

(54) SWEEP LOCK AND TILT LATCH COMBINATION

(75) Inventor: E. Erik Timothy, Macedon, NY (US)

(73) Assignee: Caldwell Manufacturing Company, Rochester, NY (US)

( * ) Notice: Subject to any disclaimer, the term of this patent is extended or adjusted under 35 U.S.C. 154(b) by 0 days.

(21) Appl. No.: 09/660,664

(22) Filed: Sep. 13, 2000

(51) Int. Cl.[7] ..... E05C 3/14

(52) U.S. Cl. ..... 292/242; 292/4; 292/DIG. 20; 292/DIG. 47

(58) Field of Search ..... 292/240, 241, 292/242, 4, 5, 7, DIG. 7, DIG. 20, DIG. 47

(56) References Cited

U.S. PATENT DOCUMENTS 1,120,186 A 12/1914 Eshbach
1,704,946 A * 3/1929 Lindgren ..... 292/5
2,537,736 A * 1/1951 Carlson ..... 292/182
3,953,061 A * 4/1976 Hansen ..... 292/5
4,095,829 A * 6/1978 Klompenburg ..... 292/241
4,253,688 A * 3/1981 Hosooka ..... 292/52
4,643,005 A * 2/1987 Logas ..... 70/95
5,090,750 A 2/1992 Lindqvist ..... 292/7
5,244,238 A 9/1993 Linqvist ..... 292/7
5,398,447 A * 3/1995 Morse ..... 49/185
5,791,700 A * 8/1998 Biro ..... 292/7
5,992,907 A * 11/1999 Sheldon ..... 292/34

* cited by examiner

*Primary Examiner*—Gary Estremsky
(74) *Attorney, Agent, or Firm*—Eugene Stephens & Associates

(57) ABSTRACT

A pair of sweep locks and a corresponding pair of tilt latches are combined and mounted together on an upper rail of a lower sash. The tilt latches and sweep locks are then interactively engaged so that locking the sweep locks latches the tilt latches, and unlocking the sweep locks leaves the tilt latches latched. Unlocked sweep locks allow manual unlatching of tilt latches, and relocking of sweep locks automatically relatches tilt latches.

8 Claims, 6 Drawing Sheets

SWEEP LOCK AND TILT LATCH COMBINATION

TECHNICAL FIELD

Sweep locks and tilt latches for window sash that open and close vertically and tilt from a vertical plane

BACKGROUND

"Sweep lock" is the common name of a cam lock mounted on an upper rail of a lower sash to lock the lower sash to a fixed or movable upper sash in a window. Sweep locks can be used in pairs spaced toward the sides of window sash to interlock the check rails of a pair of closed sash. When locked, sweep locks prevent either sash from moving toward an open position and also strengthen the wind resistance of the closed sash.

"Tilt latch" is the common name of a latch that keeps a tiltable sash in an upright position for traveling vertically between open and closed positions within a window jamb. Ordinarily, a pair of tilt latches are arranged at stile edges of a lower sash to latch into vertical slots in a window jamb where the tilt latches prevent a lower sash from tilting until the tilt latches are manually unlocked.

Since sweep locks and tilt latches are both mounted on an upper rail of a lower sash, there have been several suggestions in the patent literature that these devices be combined. See for example U.S. Pat. Nos. 1,120,186; 5,090,750; 5,244,238; 5,398,447; and 5,791,700. All these suggestions suffer from disadvantages such as expense, inconvenience, and cumbersome actuation. Some of them also cause simultaneous actuation of sweep locks and tilt latches in undesirable ways. In contrast to these drawbacks, the present invention aims at a low cost, convenient, and functionally desirable interaction of sweep locks and tilt latches.

SUMMARY OF THE INVENTION

The invention achieves this improvement by mounting a corresponding pair of sweep locks and tilt latches adjacent each other so that each sweep lock and each tilt latch are manually movable. The sweep locks are arranged to block unlatching movement of the tilt latches, though, whenever the sweep locks are locked. Also, locking the sweep locks moves unlatched tilt latches into latched positions. The only time tilt latches can be unlatched is when corresponding sweep locks are unlocked.

This arrangement assures that tilt latches are latched whenever sweep locks are locked so that the window enjoys maximum possible strength whenever sweep locks are locked. It also requires that the sweep locks be unlocked before tilt latches can be unlatched so that no one attempts to tilt a sash that is held in place with a sweep lock. Since sweep locks are used for locking windows for security and wind-resistance purposes, such an arrangement assures that tilt latches are also latched for the same purposes, whenever the sweep locks are locked. The arrangement also prevents accidental unlatching of tilt latches whenever sweep locks are locked. In normal practice, sweep locks are used more frequently than tilt latches, which are unlatched for tilting a sash inward for washing or repair. The more frequently used sweep locks then ensure that tilt latches remain latched until tilting of a sash is desired, and sweep locks are also unlocked for this purpose.

DRAWINGS

Figure 9:
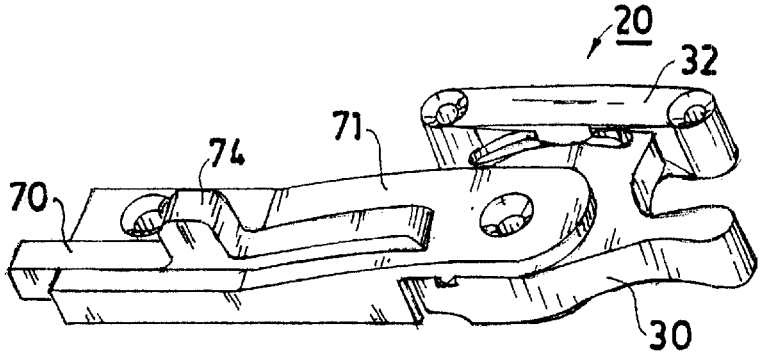
FIGS. 9–11 are isometric top and front side views of another preferred embodiment of sweep lock and tilt latch combination shown in FIG. 9 with the sweep lock locked and the tilt latch latched, In FIG. 10 with the sweep lock unlocked and the tilt latch latched, and in FIG. 11 with the sweep lock unlocked and the tilt latch unlatched.
Figure 10:
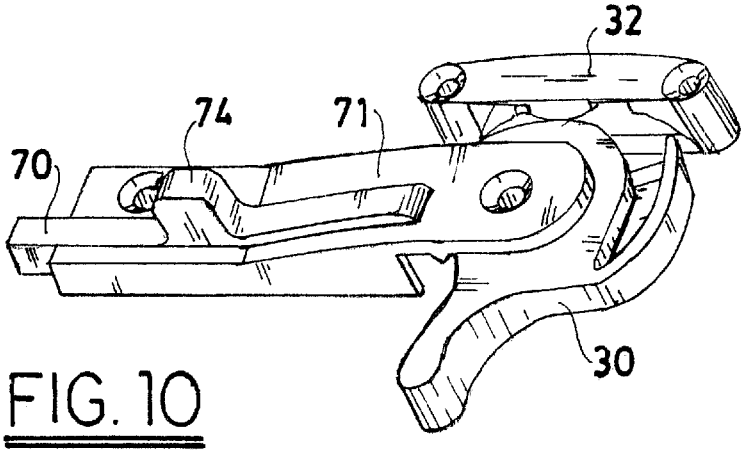
Figure 11:
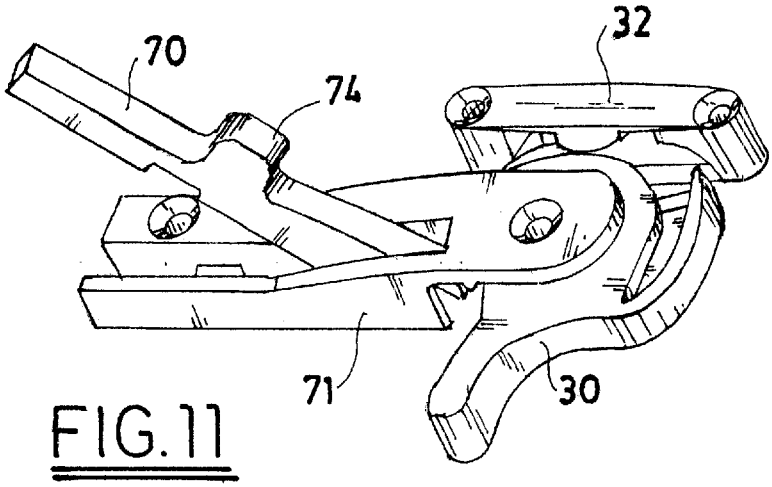
Figure 12:
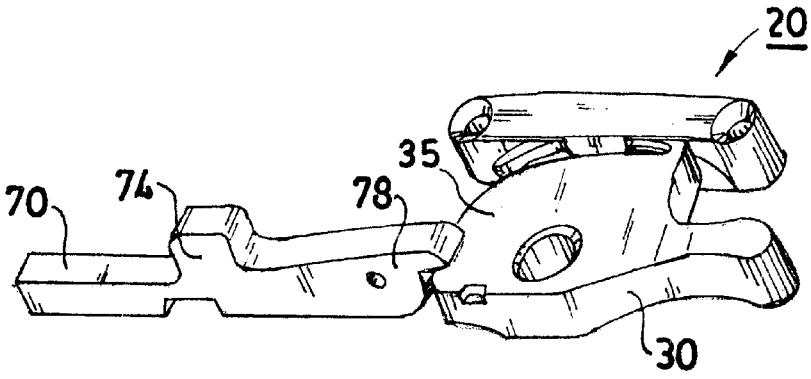
Figure 13:
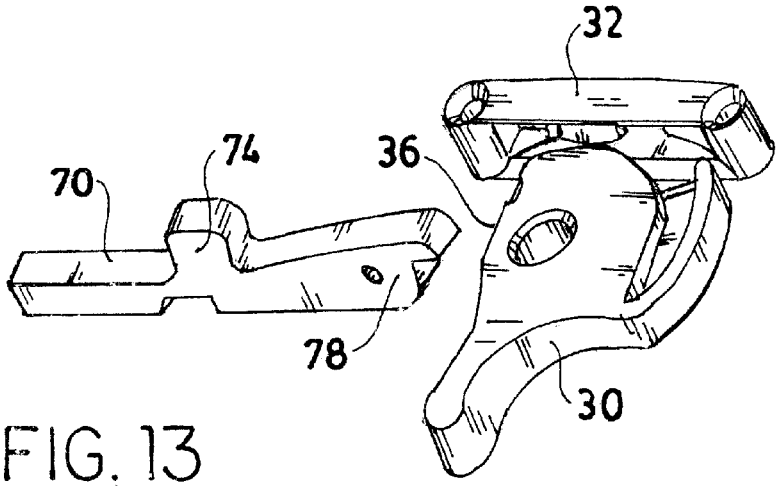
Figure 14:
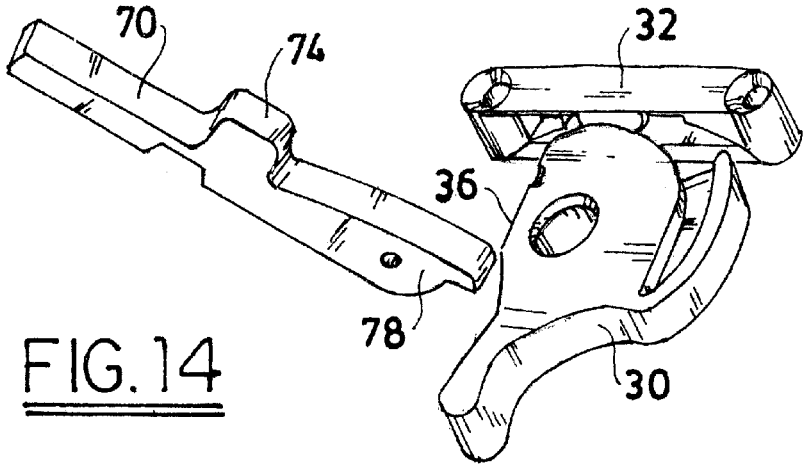

FIGS. 12–14 correspond respectively with FIGS. 9–11 and show the embodiment of FIGS. 9–11 with the tilt latch housing removed to illustrate the interaction of the sweep lock and the tilt latch, with FIG. 12 showing the positions of FIG. 9, FIG. 13 showing the positions of FIG. 10, and FIG. 14 showing the positions of FIG. 11.

DETAILED DESCRIPTION

Figure 1:
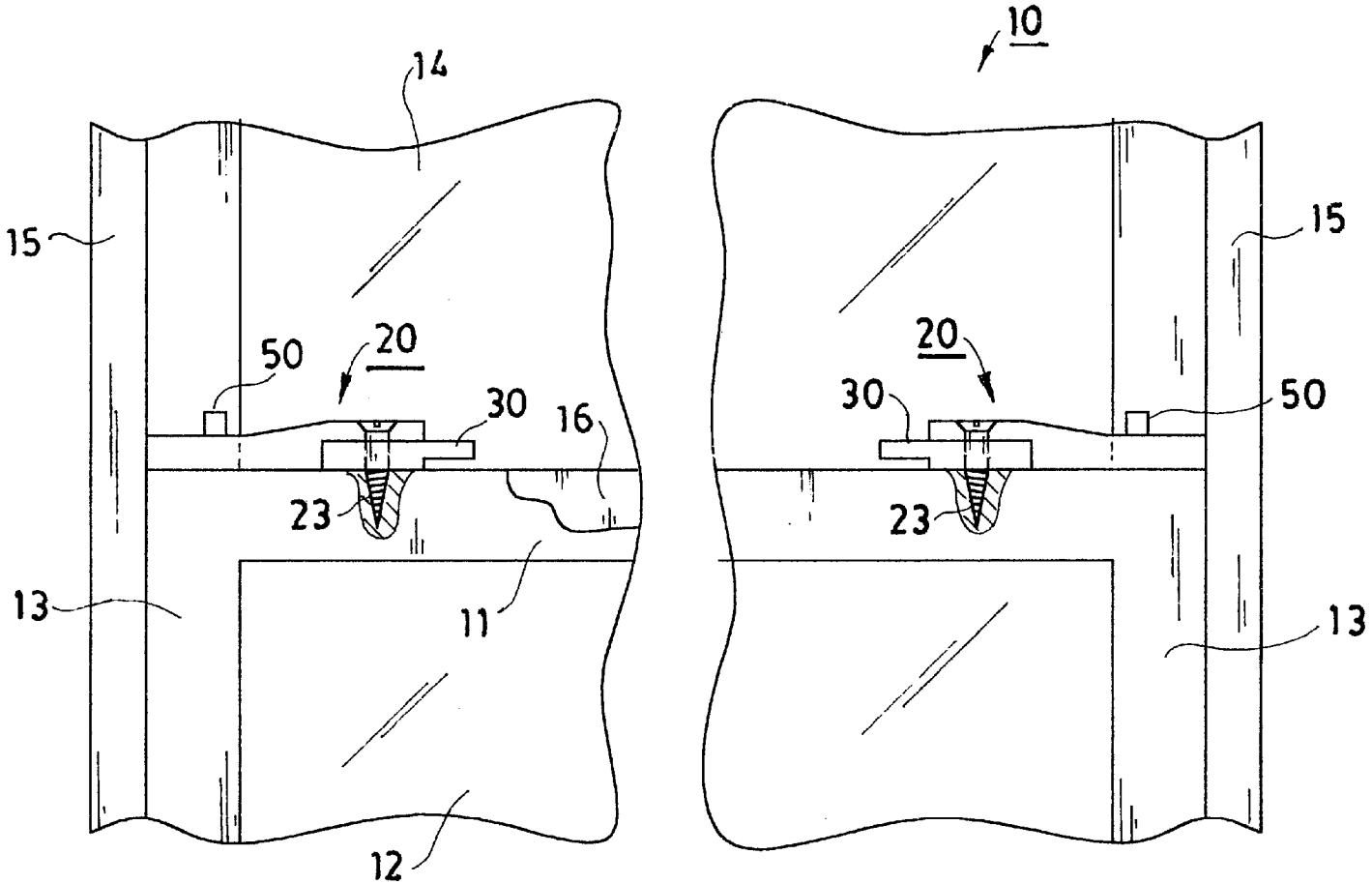
FIG. 1 is a fragmentary schematic view of a pair of sweep locks and tilt latches arranged according to the invention to lock a sash within a window.

FIG. 1 shows preferred positioning of the inventive combination of sweep lock and tilt latch arranged in window 10. A pair of combined sweep locks 30 and tilt latches 50 are arranged on an upper or check rail 11 of lower sash 12. Combined sweep locks and tilt latches 20 are arranged toward stile edges 13 of sash 12 so that sweep locks 30 can interlock with a lower or check rail 16 of upper sash 14 aligned with lower sash check rail 11, and tilt latches 50 can latch into vertical grooves in window jambs 15 to prevent lower sash 12 from tilting unless tilt latches are unlatched. Throughout this application, window jambs 15 are intended to include jamb liners such as used in wooden windows, as well as polyvinyl chloride (PVC) window jambs. Both jambs and jamb liners have vertical grooves or slots that tilt latches 50 can latch into, to hold a sash upright.

FIGS. 2–8 illustrate specifics of a preferred embodiment of sweep lock and tilt latch combination 20. In this embodiment, each combination includes a cam-type sweep lock 30 and a sliding type of tilt latch 50 configured to interact with each other in the different positions shown in the drawings. A housing 51 of tilt latch 50 has an overlap region 52 that overlies sweep lock cam 30 and provides a pivotal mount for sweep lock 30. The overlap region 52 of housing 51 includes a mounting screw bushing 53 that extends through a pivot axis opening 33 in sweep lock 30. Bushing 53 not only affords a pivot mount for sweep lock 30, but also receives a mounting screw 23 that secures both sweep lock 30 and overlap region 52 of housing 51 securely in place on upper rail 11 of lower sash 12.

Sweep lock 30 includes a cam lock 31 that interlocks with a receiver 32 mounted on lower rail 16 of upper sash 14. Receiver 32 is preferably molded with screw-receiving openings 34 so that it can be conveniently secured to upper sash check rail 16.

Tilt latch housing 51 extends toward window jamb 15 from sweep lock 30, and preferably includes a bushing 54 that receives a screw securing housing 51 to check rail 11. Tilt latch 50 formed as a laterally movable slide is arranged within housing 51 to move into latched positions shown in FIGS. 2, 3, 5, and 6 and in an unlatched position shown in FIGS. 4 and 7. Latch end 55 of tilt latch slide 50 extends from housing 51 into latching engagement with a window jamb 15 in the latched position and retracts from a window jamb 15 in the unlatched position. A manually grippable projection 59 operates tilt latch 50 to slide back and forth within housing 51. Bar 59 moves laterally within an opening 56 in housing 51, and tilt latch slide 50 has a generally oval opening 57 that can slide past screw bushing 53 to accommodate lateral movement of latched slide 50. Oval opening 57 preferably has a central detent 58 formed as a narrowed region of oval 57, to detent latch slide 50 against bushing 53 in either a latched or an unlatched position.

Tilt latches are also made with springs biasing them lightly toward latched positions and with latch ends that are cammed like door latches. Such latches can be manually retracted against the spring pressure to tilt a sash, and such latches cam over a window jamb and snap into jamb grooves as a sash is moved from a tilted to an upright position. Such an arrangement is common in PVC windows, and such spring-biased tilt latches can be made to cooperate with sweep locks according to the invention.

A cam lock region 35 is disposed to block unlatching movement of tilt latch slide 50 whenever sweep lock 30 is locked. An adjacent region 36 of sweep lock 30 is disposed to allow sliding movement of tilt latch 50 whenever sweep lock 30 is unlocked. An end 48 of tilt latch 50 engages sweep lock surfaces 35 or 36, depending on the locked or unlocked condition of sweep lock 30 and the latched or unlatched condition of tilt latch 50.

Figure 4:
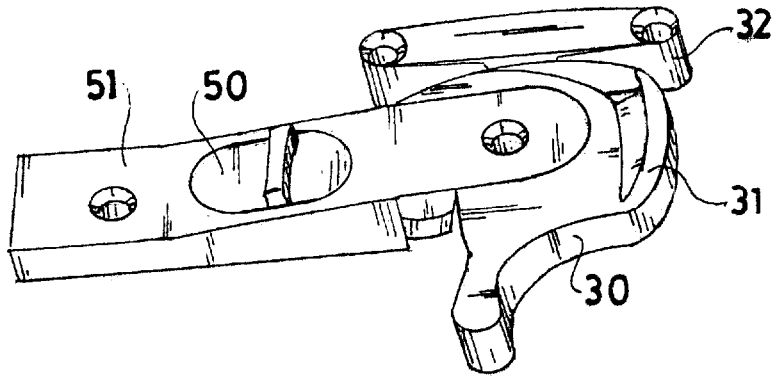
Figure 7:
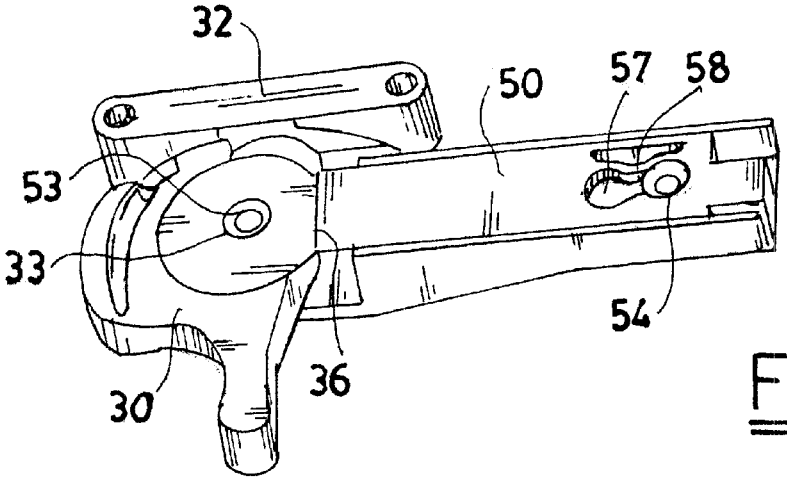
Figure 8:
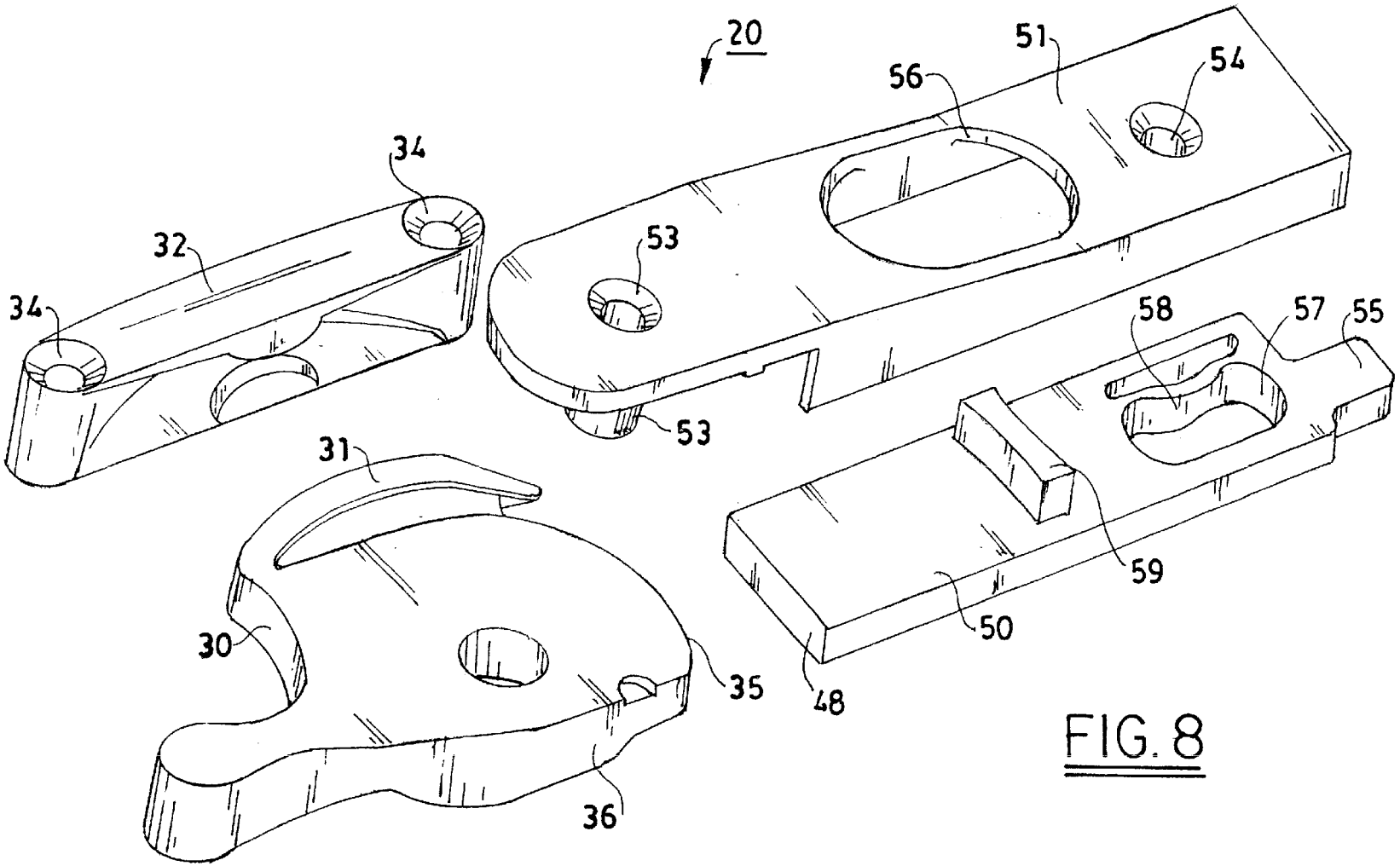
FIG. 8 is an isometric exploded view of the preferred embodiment of FIGS. 2–7.

Sweep lock and tilt latch combination 20 operates as follows. When sweep lock 30 is unlocked and tilt latch 50 is unlatched, as shown in FIGS. 4 and 7, lower sash 12 is unlocked from upper sash 14 and is free to tilt out of the plane of window 10. This condition is useful for washing or repairing sash 12. If tilt latches are spring biased into latched positions, they are latched whenever lower sash 12 is untilted; and the tilt latches have to be moved manually to unlatched positions to tilt an unlocked lower sash 12.

Figure 2:
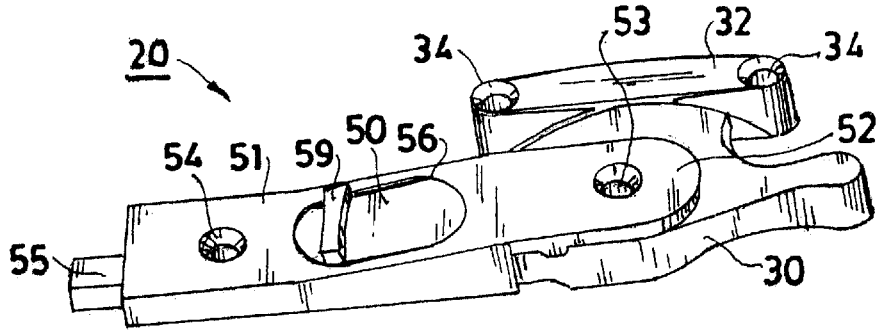
FIGS. 2–4 are isometric top and front side views of a preferred embodiment of sweep lock and tilt latch combination shown in FIG. 2 with the sweep lock locked and the tilt latch latched, in FIG. 3 with the sweep lock unlocked and the tilt latch latched, and in FIG. 4 with the sweep lock unlocked and the tilt latch unlatched.
Figure 5:
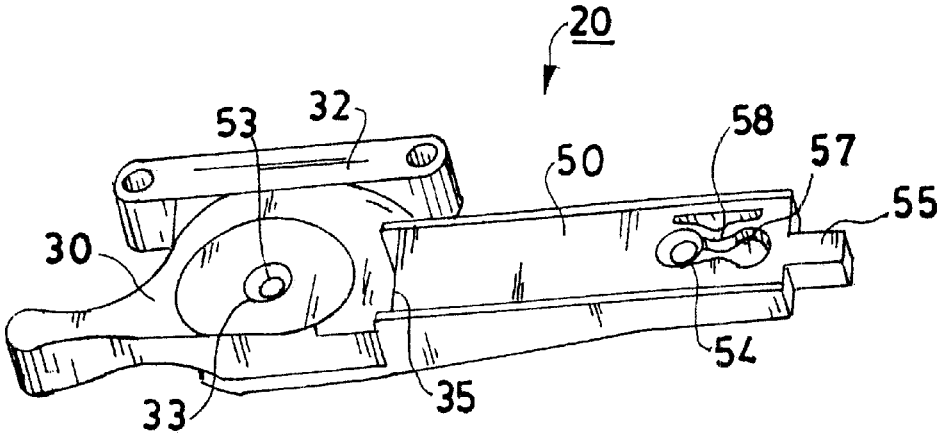
FIGS. 5–7 show an isometric bottom and front side view of the preferred embodiment of sweep lock and tilt latch combination of FIGS. 2–4 with FIG. 5 corresponding to the positions of FIG. 2, FIG. 6 corresponding to the positions of FIG. 3, and FIG. 7 corresponding to the positions of FIG. 4.

When sweep lock 30 is locked, as shown in FIGS. 2 and 5, tilt latch 50 is latched and blocked from unlatching. As sweep lock 30 moves from an unlocked to a locked position, its cam surface 35 engages tilt latch end surface 48 so that tilt latch 50 slides into a latched position as sweep lock 30 rotates into a locked position. This feature is unnecessary for tilt latches that are spring biased into latched positions and automatically latch whenever lower sash 12 is untilted. Otherwise, locking sweep locks 30 not only interlock sash 12 with sash 14 but also latch tilt latch slides 50 into window jambs 15 for maximum window strength and wind resistance. Neither sash can move up or down or tilt, and window 10 has maximum wind resistance.

Figure 3:
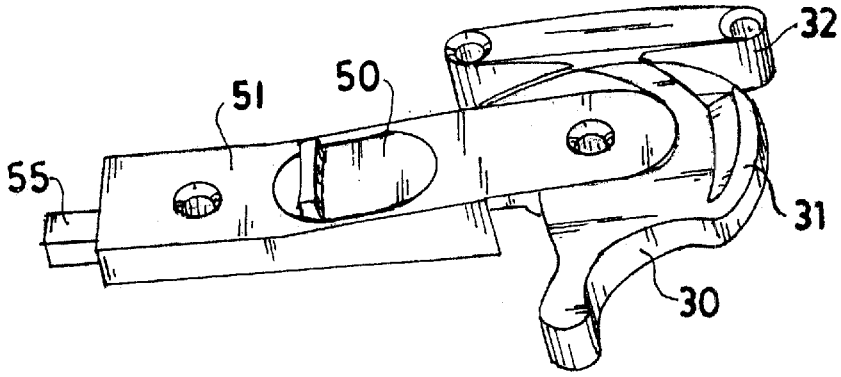
Figure 6:
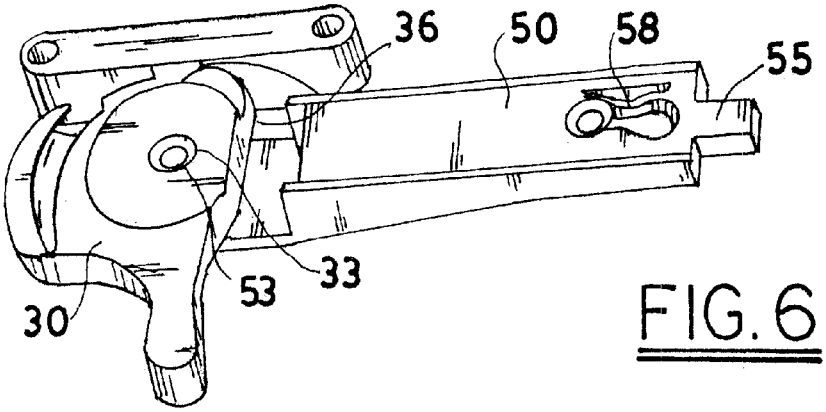

If lower sash 12 is to be raised or upper sash 14 is to be lowered, sweep locks 30 are unlocked to the position shown in FIGS. 3 and 6. This moves sweep lock surfaces 35 out of the path of tilt latches 50 and disposes sweep lock surfaces 36 to confront ends 48 of tilt latches 50 across gaps, as best shown in FIG. 6. In such condition, lower sash 12 can be moved up and down for opening and closing window 10; and upper sash 14, if also movable, can be moved down and up. Tilt latches 50 remains latched, however, and held in latched positions by detents 58, or by springs, so that lower sash 12 cannot be tilted.

If tilting of lower sash 12 is desired, it is necessary not only to unlock sweep locks 30 to the unlocked position shown in FIGS. 3 and 6, but also to manually move tilt latch slides 50 to the unlatched position shown in FIGS. 4 and 7. Lower sash 12 can then be raised within window 10 and tilted open for washing or repair.

The operation described above has the advantage of leaving tilt latch slides 50 latched unless they are deliberately manually unlatched. Unlocking sweep locks 30 to open a window does not unlatch tilt latches 50, which is desirable in normal operation. Also, if tilt latches 50 are unlatched, they automatically become relatched whenever sweep locks 30 are locked. This ensures that someone locking window 10 with sweep locks 30 will get the additional strength and wind resistance afforded by latching tilt latches 50.

A requirement for unlatching tilt latches 50 is that sweep locks 30 must first be unlocked. This is not an inconvenience, however, because tilting sash 12 requires that sweep locks 30 be unlocked. The arrangement thus allows deliberate unlatching of tilt latches 50 whenever desired and ensures that tilt latches 50 are not accidentally left unlatched when tilting of sash 12 is not desired and window 10 is locked.

Although most tilt latches slide back and forth in ways similar to the one shown in the embodiment of FIGS. 2–8, it is also possible for a tilt latch combined with a sweep lock to rotate in and out of latched position as shown in the embodiment of FIGS. 9–14. There, sweep lock 30 and lock receiver 32 have essentially the same form as shown for the embodiment of FIGS. 2–8; but tilt latch 70 is mounted to pivot, and housing 71 is altered to accommodate pivotal latching and unlatching. A manually grippable projection 74 extending above housing 71 allows tilt latch 70 to be lifted to the unlatched position shown in FIGS. 11 and 14. Tilt latch 70 can also be manually moved downward to the latched position shown in FIGS. 9, 10, 12, and 13. Detents are preferred for holding tilt latch 70 in both latched and unlatched positions so that tilt latch 70 will not become unlatched while a sash is moving downward and will not relatch by gravity from an unlatched position.

A cam end 78 of tilt latch 70 engages surface 35 of sweep lock 30 in the locked position so that surface 35 prevents manual unlatching of tilt latch 70 whenever sweep lock 30 is locked. Cam surface 35 can also be configured so that when sweep lock 30 moves from an unlocked to a locked position, it automatically moves under cam end 78 of tilt latch 70 to force tilt latch 70 downward into a latched position.

The operation of the embodiment of FIGS. 9–14 is functionally similar to the operation of the embodiment of FIGS. 2–8. The main difference is in the manual actuation of tilt latch 70, based on a lifting and lowering motion that is possible only when sweep lock 30 is unlocked. Moving sweep locks 30 to an unlocked position leaves tilt latches 70 latched, as is desired according to the invention. When sash 12 is to be tilted, sweep locks 30 are unlocked, tilt latches 70 are lifted, and then sash 12 is free to move upward and tilt within window 10.

I claim:

1. A pair of sweep locks and a corresponding pair of tilt latches mounted on an upper rail of a lower sash of a window, each of the sweep locks being pivotally lockable to a lock receiver mounted on a lower rail of an upper sash, and each of the tilt latches having a manually movable latch element that is latchable to a jamb of the window, the combination comprising:

a. each sweep lock having a cam surface that moves between a locked and an unlocked position as the sweep lock rotates respectively between locked and unlocked positions;

b. each sweep lock being mounted adjacent a respective one of the tilt latches so that the sweep lock cam surfaces in the locked positions are disposed to block unlatching movement of the respective latch elements;

c. the sweep lock cam surfaces in the unlocked positions being disposed clear of the respective latch elements to permit manual unlatching of the tilt latches; and d. the sweep lock cam surfaces respectively engaging and moving unlatched latch elements into latched positions when the sweep locks move from unlocked to locked positions.

2. The combination of claim 1 wherein housings for the tilt latches are respectively interconnected with mounts for the sweep locks.

3. The combination of claim 2 including mounting screws extending respectively through the tilt latch housings and the sweep lock mounts and into the upper rail of the lower sash.

4. The combination of claim 1 wherein the latch elements detent in latched positions within tilt latch housings.

5. A combined sweep lock and tilt latch mounted with a window frame, the combination comprising:

a. the sweep lock and tilt latch being mounted adjacent each other;

b. the tilt latch having a latch element latching to a window frame that is manually movable within a tilt latch housing between a latched position and an unlatched position;

c. the sweep lock having a rotatable cam movable between a locked position and an unlocked position;

d. the sweep lock cam in the locked position blocking manual movement of the latch element to the unlatched position;

e. the sweep lock cam in the unlocked position not blocking manual movement of the latch element to the unlatched position;

f. the sweep lock and tilt latch being interconnected in a mount securing the sweep lock and tilt latch to the sash; and g. the mount including a screw hole in the housing of the tilt latch registered with a screw hole in a mounting hub of the sweep lock.

6. A combined sweep lock and tilt latch mounted with a window frame, comprising:

a. an interconnection configured to receive a fastener to retain the tilt latch and sweep lock adjacent each other in an operable position;

b. the tilt latch having a latch element latching to a window frame that is manually movable between a latched position and an unlatched position;

c. the sweep lock having a cam surface intersecting a path of the latch element as the sweep lock rotates from an unlocked to a locked position;

d. the sweep lock cam in the locked position being positioned to block unlatching movement of the latch element; and e. the interconnection including a screw hole in a housing for the tilt latch arranged to register with a screw hole in a mounting hub for the sweep lock.

7. A combined sweep lock and tilt latch mounted with a window frame, comprising:

a. an interconnection configured to receive a fastener to retain the tilt latch and sweep lock adjacent each other in an operable position;

b. the tilt latch having a latch element latching to a window frame that is manually movable between a latched position and an unlatched position;

c. the sweep lock having a cam surface intersecting a path of the latch element as the sweep lock rotates from an unlocked to a locked position;

d. the sweep lock cam in the locked position being positioned to block unlatching movement of the latch element; and e. a detent arranged between a tilt latch housing and the latch element to retain the slide in the latched position until manually overridden.

8. A combined sweep lock and tilt latch mounted with a window frame, the combination comprising:

a. the sweep lock and tilt latch being mounted adjacent each other;

b. the tilt latch having a latch element latching to a window frame that is manually movable within a tilt latch housing between a latched position and an unlatched position;

c. the sweep lock having a rotatable cam movable between a locked position and an unlocked position;

d. the sweep lock cam in the locked position blocking manual movement of the latch element to the unlatched position;

e. the sweep lock cam in the unlocked position not blocking manual movement of the latch element to the unlatched position and;

f. the latch element detenting within the housing in the latched position.

* * * * *